United States Patent [19]

Schaper et al.

[11] Patent Number: 4,782,265

[45] Date of Patent: Nov. 1, 1988

[54] ELECTROCHEMICAL LUMINESCENT CELL

[75] Inventors: Hartwig Schaper, Roetgen; Erwin Schnedler; Karl H. Wilhelm, both of Aachen, all of Fed. Rep. of Germany

[73] Assignee: U.S. Philips Corporation, New York, N.Y.

[21] Appl. No.: 693,329

[22] Filed: Jan. 22, 1985

Related U.S. Application Data

[63] Continuation of Ser. No. 354,317, Mar. 3, 1982, abandoned.

[30] Foreign Application Priority Data

Mar. 20, 1981 [DE] Fed. Rep. of Germany ..... 3110879

[51] Int. Cl.[4] ..... H01J 7/42

[52] U.S. Cl. ..... 313/483; 313/494; 313/358

[58] Field of Search ..... 313/483, 494, 358, 232; 362/34; 252/700; 350/336

[56] References Cited

U.S. PATENT DOCUMENTS

| | | | |
|---|---|---|---|
| 4,086,003 | 4/1978 | Kouchi et al. | 313/483 X |
| 4,163,920 | 8/1979 | Lambe et al. | 313/503 |
| 8,361,347 | 1/1975 | Coderre et al. | 313/483 X |

*Primary Examiner*—David K. Moore
*Assistant Examiner*—Sandra L. O'Shea
*Attorney, Agent, or Firm*—Norman N. Spain

[57] ABSTRACT

Electrochemical luminescent cell having a spacing of the plates (1, 2) provided with electrodes (5 and 6, respectively) from 10 to 100 μm, in which at least one of the oppositely located electrodes has a grid structure (13) or surface roughness, the size and mutual hole distance and maximum surface roughness of which, respectively, lie in the order of magnitude of the spacing (3) of the electrode plates.

3 Claims, 2 Drawing Sheets

ELECTROCHEMICAL LUMINESCENT CELL

This is a continuation of application Ser. No. 354,317, filed Mar. 3, 1982, now abandoned.

The invention relates to an electrochemical luminescent cell comprising a container filled with a solution of a substance capable of electroluminescence in a solvent thereof and bounded by two parallel spaced plates provided on the opposing surfaces with operating and counter electrodes, respectively, at least one of said electrodes being formed of an electrically conductive translucent material.

Such electrochemical luminescent cells (ECL cells) constructed as thin-layer systems are described in Phys. Lett. A, 76 A (1980), 455–458 and form the subject matter of German Patent Applications P 29 49 967.0 and P 30 29 469.0. In the known ECL cells the plates which consist of glass or a synthetic resin on their inner sides supporting the electrodes are formed so as to be completely smooth and flat. The translucent electrodes usually consit of tin-doped indium oxide layers having a thickness from 0.2 to 0.5 μm. Non-translucent electrodes, if any, consist, for example, of gold, silver, aluminium or platinum. The electrodes themselves have no particular structure but consist of a uniformly provided layer.

The charge and material transport, respectively, in the electrolyte-free ECL cells occur predominantly by electrohydrodynamically energized convection of the solution. In accordance with the energetically most favorable conditions for the system viscosity of the solution flowing between the electrodes is such as that certain regular flow structures are formed and as a result there is a minimum mixing of the ions flowing between the two electrodes. However, this has for its result that only small parts of the anion and cations of the substance capable of electrochemical luminescence can collide, and therefore can recombine and can luminesce. This is also a reason for the comparatively low efficiency of the known ECL cells.

It is therefore the object of the invention to provide ECL cells having a higher efficiency.

According to the invention this object is achieved in an ECL cell of the kind mentioned in the opening paragraph in that at least one of the oppositely located electrodes has a grid structure or surface roughness, in which the size and the mutual spacing of the holes of the grid structure and the maximum surface roughness, respectively, lie in the order of magnitude of the spacing of the electrode plates.

In this manner a disturbance of the regularity of the above-described flow between the electrodes is achieved so that a better mixing of the flowing solution is obtained. The flow is always disturbed when one or both electrodes have structures which do not fit in the ideal flow form. In this manner efficiency improvements from 100 to 200% can be reached.

In order that the electrode(s) have the desired surface roughness, roughened electrode(s), the electrode plate in question may be roughened. A maximum roughness of approximately 1 to 100 μm can, for example, be reached by grinding. In ECL cells having such ground plates with a maximum roughness of, for example 70 μm, efficiency improvements of 170% were reached.

Electrodes having a grid structure, that is to say having holes, can be produced on the electrode plate by means of known photoetching methods. The holes have either a circular, quadratic or hexagonal form. The size and the mutual spacing of the holes may be approximately 5 to 500 μm.

An embodiment according to the invention will now be described in greater detail with reference to the drawing. In the drawing.

Figure 1:
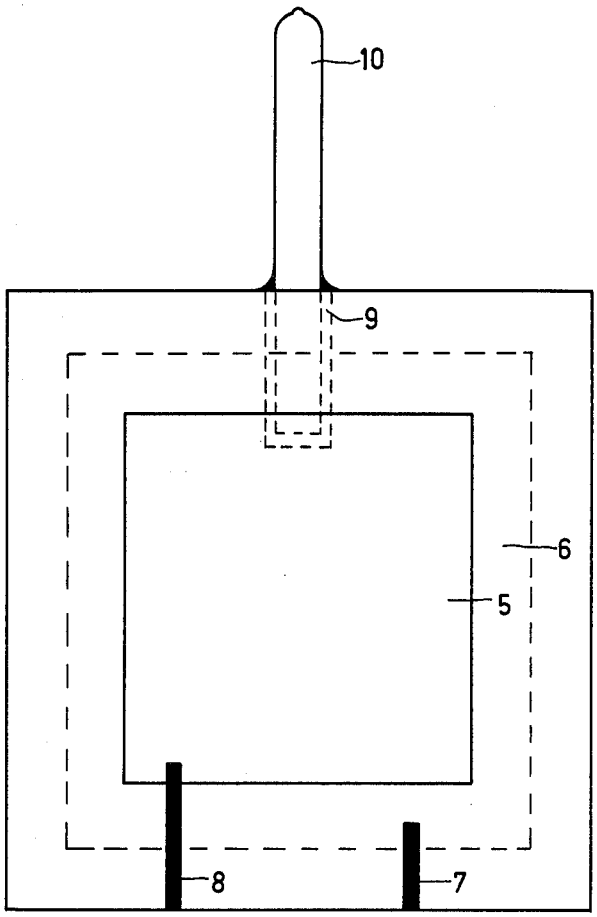
FIG. 1 is a front elevation of a thin-layer ECL cell.
Figure 2:
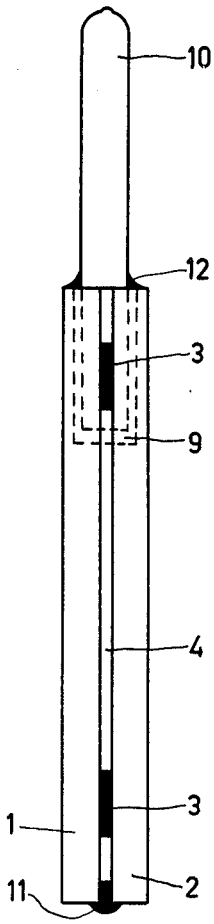
FIG. 2 is a side elevation of the cell shown in FIG. 1.
Figure 3:
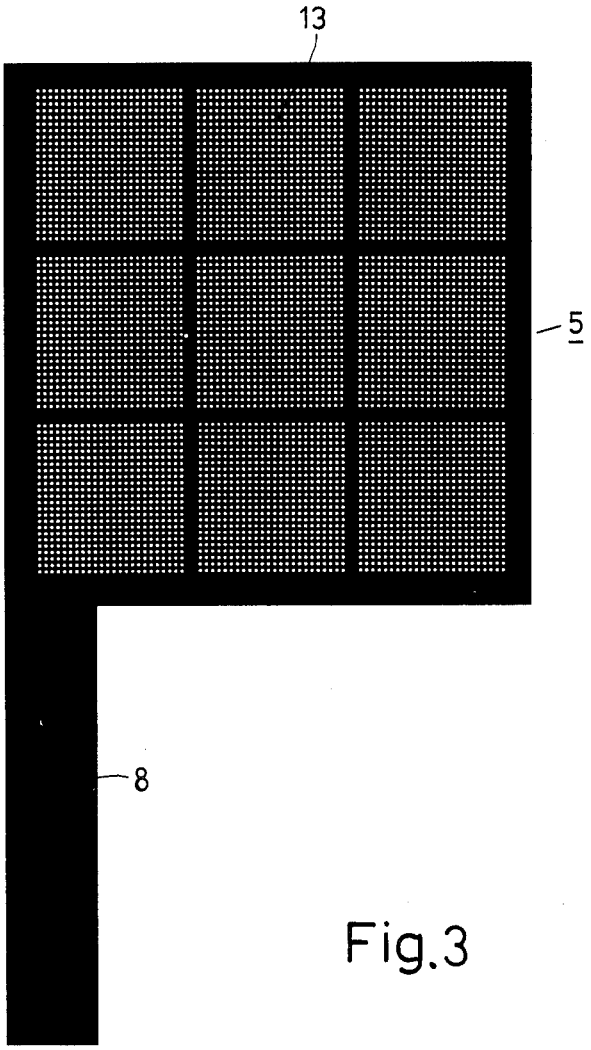
FIG. 3 shows an electrode having a grid structure used in the cell shown in FIGS. 1 and 2.

and FIG. 4 a side elevation of an electrode in the cell shown in FIGS. 1 and 2 which electrode has a roughened surface.

The ECL cell consists of two plane parallel glass plates 1 and 2 which are separated from each other by a 10 to 100 μm thick spacer 3 which also bounds the chamber 4 of the cell. At the area of the chamber 4 of the cell, electrodes 5 and 6, respectively, are provided in thin layers on the inner sides of the glass plates 1 and 2, from which electrodes contact paths 7 and 8 form the electric connections leading up to the edge of the glass plates 1 and 2. On the upper side a hole 9 is formed in the glass plates 1 and 2 and extends into the chamber 4. A filling nozzle 10 is inserted in the hole 9 for adding the ECL solution in a corresponding protective gas device. The cell is sealed by seals 11 and 12 in accordance with the requirements of high-vacuum technology. The chamber 4 of the ECL cell is filled, for example, with an electrolyte-free solution of rubrene (5, 6, 11, 12-tetraphenyltetracene) in 1,2-dimethoxyethane. The cell is operated with direct current and fed from a direct voltage source of approximately 3 to 10 volts. Such an ECL cell forms the subject matter of the prior German Patent Application P 29 49 967.0.

Both electrodes 5 and 6 consist, for example, of $In_2O_3$: Sn-layers. At least one of the electrodes - in the present case the electrodes 5 - has a grid structure 13 with a network of regularly provided circular and quadratic holes, respectively, from 5 to 500 μm diameter. It serves as an operating electrode and was structured by means of a photo-etching method after deposition of the layer on a surface of the glass plate 2. The non-structured counter electrode 6 is vapour-deposited as a uniform layer on the inside of the glass plate 1. Instead of the grid structure 13 the electrode 5 may also be formed as a uniform layer and obtain a surface roughness by being deposited upon a roughened surface of the glass plate 2 which roughened surface has a maximum roughness of approximately 1 to 10 micrometers. An electrode having such a roughened surface is shown in side elevation in FIG. 4. of the glass plate 2.

The structured operating electrode need not be in the form of a large area but may also be subdivided into several display segments. In this case, only these display segments need be provided with a grid structure or surface roughness. It is also possible, instead of the operating electrode, to structure the counter electrode at the area of the operating electrode and its display segments, respectively. If desired, both electrodes may also be provided with display segments, so that the two electrodes operate as operating electrodes at the area of the display segments and operate as counter-electrodes with their faces situated opposite to the display segments.

What is claimed is:

1. An electrochemical luminescent cell having a chamber filled with a solution of a substance capable of electrochemical luminescence and which chamber is bounded by two parallel spaced plates which plates are provided on their opposing surfaces, in contact with said solution, with operating and counter-electrodes respectively, at least one of which electrodes consists of an electrically-conductive translucent material, characterized in that at least one of said electrodes has a grid structure in which the size and mutual spacing of the holes of the grid structure lie in the order of magnitude of the spacing between said electrodes and in which the mutual spacing of said holes is sufficient to cause a disturbance in the flow of the solution which flow occurs upon energization of said electrodes.

2. An electrochemical luminescent cell having a chamber filled with a solution of a substance capable of electrochemical luminescence and which chamber is bounded by two parallel spaced plates which plates are provided on their opposing surfaces with operating and couterelectrodes in contact with said solution respectively, at least one electrode of which consists of an electrically-conductive translucent material, characterized in that at least one of said electrodes has a surface roughness, a maximum of which lies in the order of magnitude of the spacing between said electrodes and which roughness is sufficient to cause a disturbance in the flow of the solution between said electrodes which flow occurs upon energization of said electrodes.

3. An electrochemical cell as claimed in claim 2 wherein the electrode having the surface roughness is produced by roughening the underlying surface of underlying plate and then vapor depositing a conductive layer on said roughened surface.

* * * * *